US010993553B2

(12) United States Patent
Drew

(10) Patent No.: US 10,993,553 B2
(45) Date of Patent: May 4, 2021

(54) WALL RACK WITH PIVOTING EXTENSIONS

(71) Applicant: Delta Cycle Corporation, Randolph, MA (US)

(72) Inventor: Errol Drew, Los Gatos, CA (US)

(73) Assignee: Delta Cycle Corporation, Randolph, MA (US)

( * ) Notice: Subject to any disclaimer, the term of this patent is extended or adjusted under 35 U.S.C. 154(b) by 0 days.

(21) Appl. No.: 16/879,082

(22) Filed: May 20, 2020

(65) Prior Publication Data

US 2020/0375374 A1 Dec. 3, 2020

Related U.S. Application Data

(60) Provisional application No. 62/854,429, filed on May 30, 2019.

(51) Int. Cl.

| | |
|---|---|
| ***A47F 5/08*** | (2006.01) |
| ***A63C 11/02*** | (2006.01) |
| ***A47B 96/07*** | (2006.01) |
| ***A47B 61/02*** | (2006.01) |

(52) U.S. Cl.

CPC ..... *A47F 5/0838* (2013.01); *A47B 61/02* (2013.01); *A47B 96/07* (2013.01); *A47F 5/0869* (2013.01); *A63C 11/028* (2013.01); *A47B 2220/0044* (2013.01); *A63C 2203/44* (2013.01)

(58) Field of Classification Search

CPC ..... A47F 5/0838; A47F 5/0869; A47F 5/10; A63C 11/028; A63C 2203/44; A47B 2220/004; A47B 96/07; A47B 61/02; A47B 81/005; A47B 96/06; A47B 96/061; A47B 96/068; A47B 2220/0036; A47B 2220/0041; A47B 2220/0038; A47B 57/045; A47B 57/42; A47B 57/56; A47G 25/0685; A47G 25/746

USPC ..... 211/85.7, 96, 193, 1.3, 710.5, 99, 104, 211/105, 150; 248/235, 240, 240.1, 248/240.3, 240.4, 241, 242, 244, 250; 108/108, 147.17

See application file for complete search history.

(56) References Cited

U.S. PATENT DOCUMENTS

| | | | | | |
|---|---|---|---|---|---|
| 224,863 | A * | 2/1880 | Blessing | A47B 96/061 | 248/241 |
| 853,344 | A * | 5/1907 | Dennis | A47B 96/061 | 248/241 |
| 908,751 | A * | 1/1909 | Cooke | A47B 57/42 | 248/224.8 |
| 1,052,961 | A * | 2/1913 | Rangnow | A47B 61/02 | 211/94.02 |
| 1,245,901 | A * | 11/1917 | Gorman | A47B 61/02 | 211/94.02 |
| 1,262,605 | A * | 4/1918 | Wheary | A47B 61/02 | 211/94.02 |
| 1,262,608 | A * | 4/1918 | Wheary | A47B 61/02 | 211/94.02 |

(Continued)

*Primary Examiner* — Jennifer E. Novosad

(74) *Attorney, Agent, or Firm* — Iandiorio Teska & Coleman, LLP

(57) ABSTRACT

A wall rack includes first and second mountable brackets, each including a plurality of spaced arms extending outwardly from the bracket for supporting items thereon. One or more arms of each bracket include a pivotable extension deployable to support wider items and storable when not needed.

10 Claims, 11 Drawing Sheets

(56) References Cited

U.S. PATENT DOCUMENTS 1,587,675 A * 6/1926 Patterson ..... A47B 61/02 211/1.3
1,668,662 A * 5/1928 Trethewey ..... A47B 61/02 211/96
1,751,691 A * 3/1930 Flath ..... F16M 11/045 248/213.1
2,142,830 A * 1/1939 Wendell ..... A47B 61/02 211/100
2,268,894 A * 1/1942 Ogren ..... A47B 61/02 211/100
D145,069 S * 6/1946 Cooper ..... D6/324
2,483,758 A * 10/1949 Douglas ..... A47B 96/07 248/242
2,642,194 A * 6/1953 Boltauzer ..... A47G 25/746 211/104
2,655,268 A 10/1953 Whaley
2,675,923 A * 4/1954 Humphrey ..... A47F 7/24 211/96
2,706,049 A * 4/1955 Andrews ..... B60R 7/10 224/482
3,096,062 A * 7/1963 Bosshart ..... A47B 96/061 248/289.11
3,158,113 A * 11/1964 Johnson ..... A47B 96/025 108/64
3,485,382 A * 12/1969 Larson ..... A47F 5/12 211/150
3,494,582 A * 2/1970 Nemeth ..... A47B 96/061 211/107
3,612,288 A * 10/1971 Lesley ..... A47F 5/0087 211/132.1
4,271,997 A * 6/1981 Michael ..... B60R 5/006 224/546
4,289,243 A * 9/1981 Arbuzoff ..... A47L 23/20 211/100
4,355,746 A * 10/1982 Casady ..... A63B 55/57 224/274
4,397,432 A * 8/1983 Resetar ..... B64D 11/00 211/193
4,426,011 A * 1/1984 Jay ..... A47B 57/44 211/182
4,465,198 A 8/1984 Martin
4,474,299 A * 10/1984 Andrews ..... A47F 7/24 211/123
4,582,015 A * 4/1986 Hunter ..... B63B 32/70 114/343
4,632,255 A * 12/1986 Kennedy ..... A47G 25/0685 211/1.3
4,693,380 A * 9/1987 Muth ..... A47B 96/061 108/46
5,092,546 A * 3/1992 Wolfbauer ..... F16L 3/22 211/193
5,310,148 A * 5/1994 Dorr ..... A47B 96/061 211/105.1
5,452,875 A * 9/1995 Kern ..... A47B 57/045 108/108
5,531,159 A * 7/1996 Stubblefield ..... A47B 46/00 108/100
5,615,783 A * 4/1997 Warnken ..... B68C 1/002 211/104
5,662,254 A * 9/1997 Lemajeur ..... B60P 3/40 224/405
5,992,648 A * 11/1999 Saunders ..... A47F 5/0846 211/35
6,126,127 A * 10/2000 Riblet ..... A47B 96/061 248/219.4
D447,683 S * 9/2001 Grosfillex ..... D8/381
6,332,660 B1 * 12/2001 Salice ..... E05D 15/262 160/207
6,345,579 B1 * 2/2002 Zaturensky ..... A47B 96/028 108/108
6,357,609 B1 * 3/2002 Van Noord ..... A47B 45/00 108/65
6,401,941 B1 * 6/2002 Maumus ..... F27D 5/005 211/59.1
7,201,282 B1 * 4/2007 Alderman ..... A47B 81/00 211/100
7,472,876 B2 * 1/2009 Jones ..... A47B 96/061 108/108
D639,150 S * 6/2011 Olson ..... D8/380
8,016,137 B2 * 9/2011 Shaha ..... A47B 96/061 211/103
8,042,229 B2 * 10/2011 Wang ..... A47B 57/26 16/270
8,500,078 B2 * 8/2013 Castellanos ..... A47B 96/06 248/339
8,540,087 B1 * 9/2013 Skaer ..... A47G 25/0685 211/85.3
8,550,259 B1 * 10/2013 McCoy ..... F16F 7/14 211/13.1
8,567,734 B2 * 10/2013 McCoy ..... H02G 3/30 248/250
8,636,154 B2 * 1/2014 Chinn ..... A61G 3/0841 211/103
D709,358 S * 7/2014 Fugett ..... D8/380
8,919,715 B2 * 12/2014 Terada ..... A47B 96/061 248/235
10,561,242 B1 * 2/2020 Ignacio ..... A47B 57/04
2003/0178382 A1 * 9/2003 Tucker ..... A47B 81/00 211/85.7
2004/0159759 A1 * 8/2004 Schultz ..... B63B 32/80 248/316.2
2006/0108302 A1 * 5/2006 Matsui ..... A63C 11/028 211/85.7
2007/0012637 A1 * 1/2007 Yu ..... A47B 46/005 211/96
2007/0241072 A1 * 10/2007 Bryant ..... A47B 96/061 211/90.02
2013/0320180 A1 * 12/2013 Castellanos ..... F41C 33/06 248/534
2015/0101525 A1 * 4/2015 Curts ..... A47B 81/00 114/343

* cited by examiner

WALL RACK WITH PIVOTING EXTENSIONS

RELATED APPLICATIONS

This application claims benefit of and priority to U.S. Provisional Application Ser. No. 62/854,429 filed May 30, 2019, under 35 U.S.C. §§ 119, 120, 363, 365, and 37 C.F.R. § 1.55 and § 1.78, which is incorporated herein by this reference.

FIELD OF THE INVENTION

This subject invention relates to wall racks.

BACKGROUND OF THE INVENTION

Various configurations of wall racks are known including some which are extendible. See U.S. Pat. Nos. 4,465,198, and 2,655,268 incorporated herein by this reference.

BRIEF SUMMARY OF THE INVENTION

Featured is a wall rack with spaced arms including an extension deployable to support wider items and movable to a stored position in the arm to support narrower items.

Featured is a wall rack comprising first and second mountable brackets wherein each bracket includes a plurality of spaced arms extending outwardly from the bracket for supporting items thereon. At least one said arm of each bracket includes a pivotable extension. Preferably there are at least two arms per bracket and each includes a pivotable extension. In one design, the at least one said arm terminates in a yoke section and the pivotable extension is received in the yoke section. The yoke section may include a pair of spaced ears each with an orifice and the pivotable extension then includes outwardly extending posts each received in a said orifice. Preferably, the pivotable extension includes a stop surface engaging the at least one arm prohibiting the pivotable extension from pivoting more than about 180° with respect to the arm. The pivoting extension may have a first surface and a second opposing surface and a proximate end curving from the first surface to a right angle edge with the second surface and the right angle edge then constitutes the stop surface.

Preferably, the at least one arm includes a top channel therein for storing the pivotable extension. The channel may include a floor terminating in an edge engaging the pivotable extension when the pivotable extension is deployed. In one design, the pivotable extension is triangular in shape. The pivotable extension may include a channel therethrough. The plurality of spaced arms may also each include a channel therethrough.

Also featured is a wall rack comprising first and second mountable brackets, a plurality of spaced arms extending outwardly from each bracket for supporting items thereon, and at least one said arm of each bracket including an extension deployable to support an item and moveable to a stored position in a channel in said arm. The at least one arm includes a top surface and the extension includes a corresponding first surface for supporting items thereon in a deployed position and an opposite surface for supporting items thereon in the stored position when the extension is stored in the arm channel.

The subject invention, however, in other embodiments, need not achieve all these objectives and the claims hereof should not be limited to structures or methods capable of achieving these objectives.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
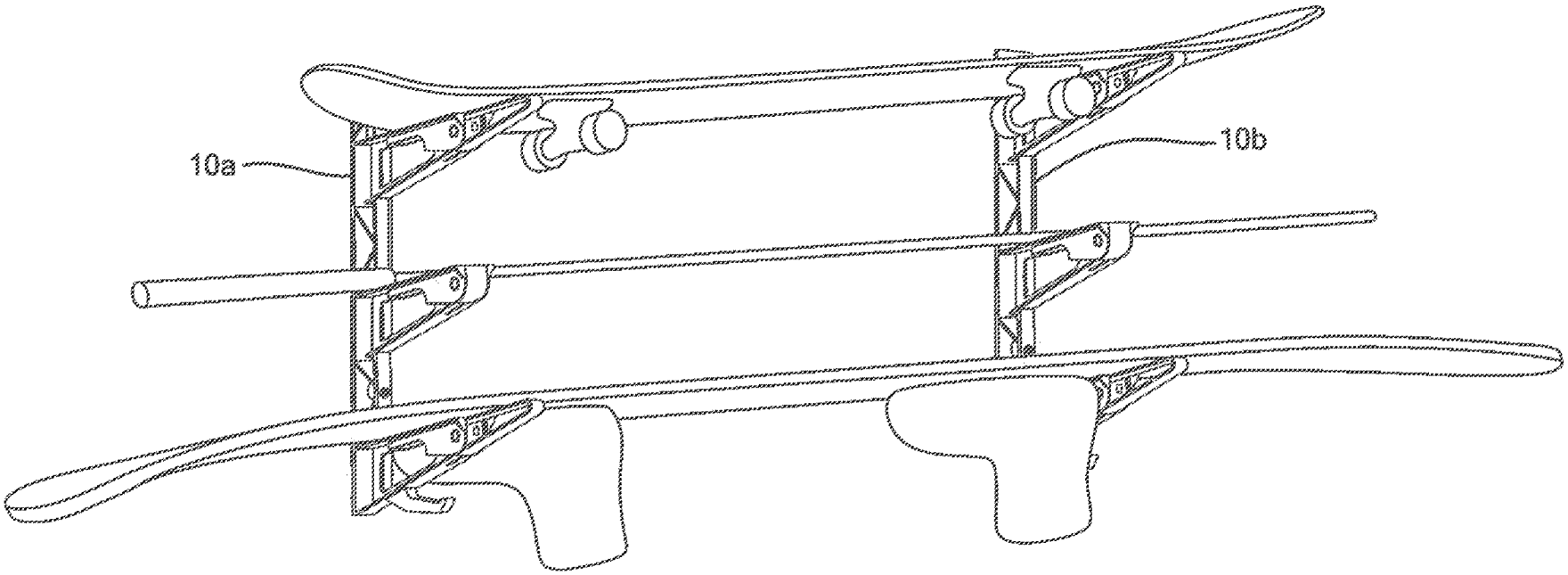
FIG. 1 is a schematic view showing an example of how the wall rack can support narrower and wider items.
Figure 2:
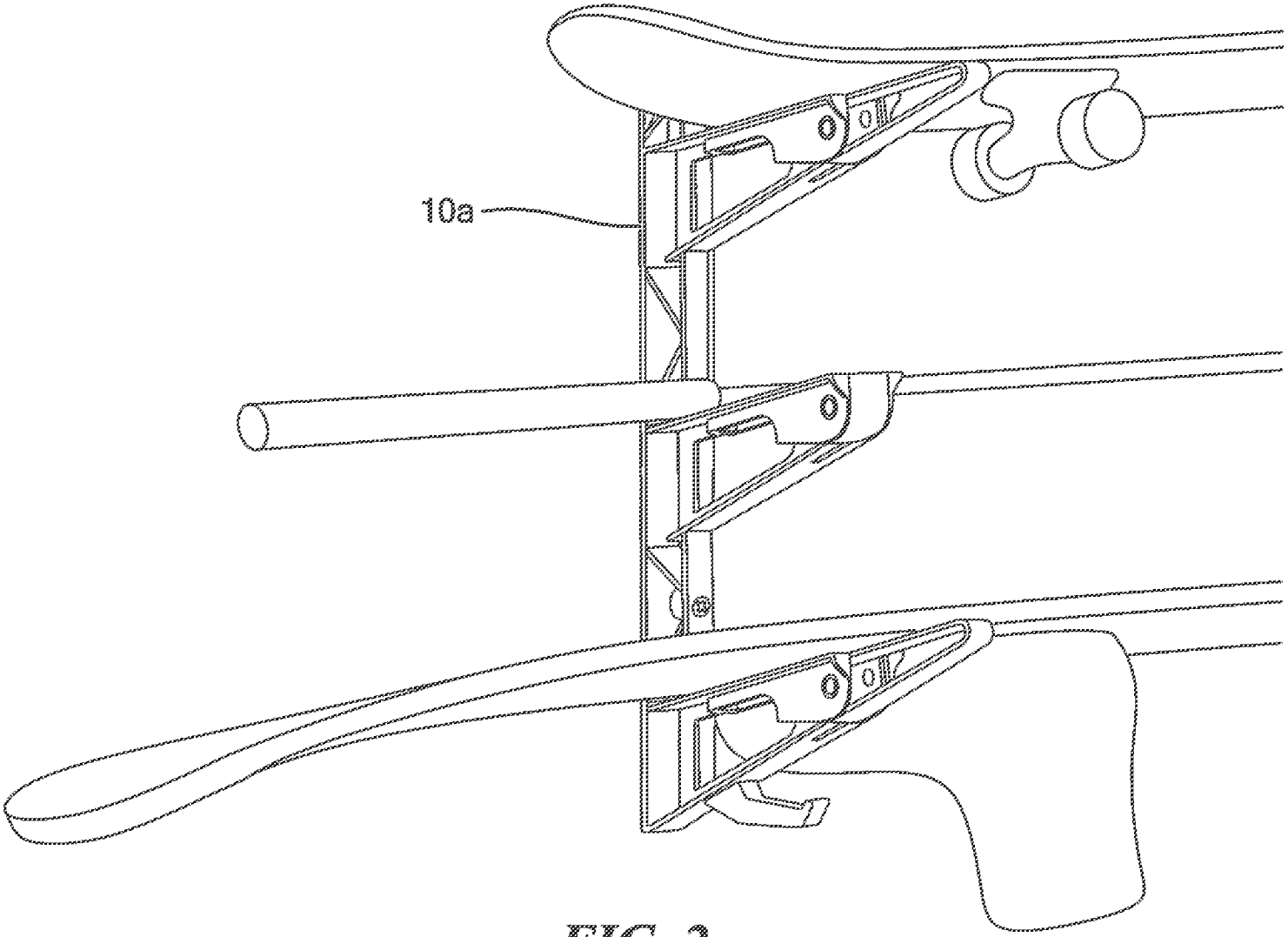
FIG. 2 is a schematic view showing a portion of the wall rack of FIG. 1.
Figure 4:
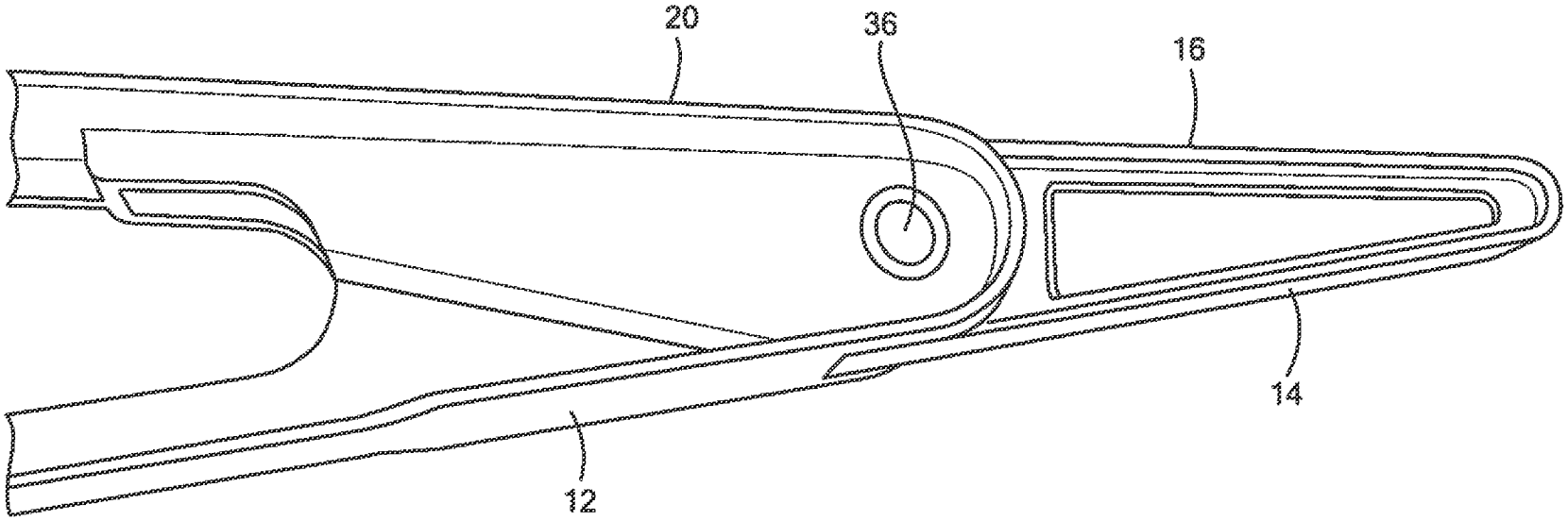
FIG. 4 is a schematic view showing a wall rack bracket arm with the extension deployed to support wider items.
Figure 5:
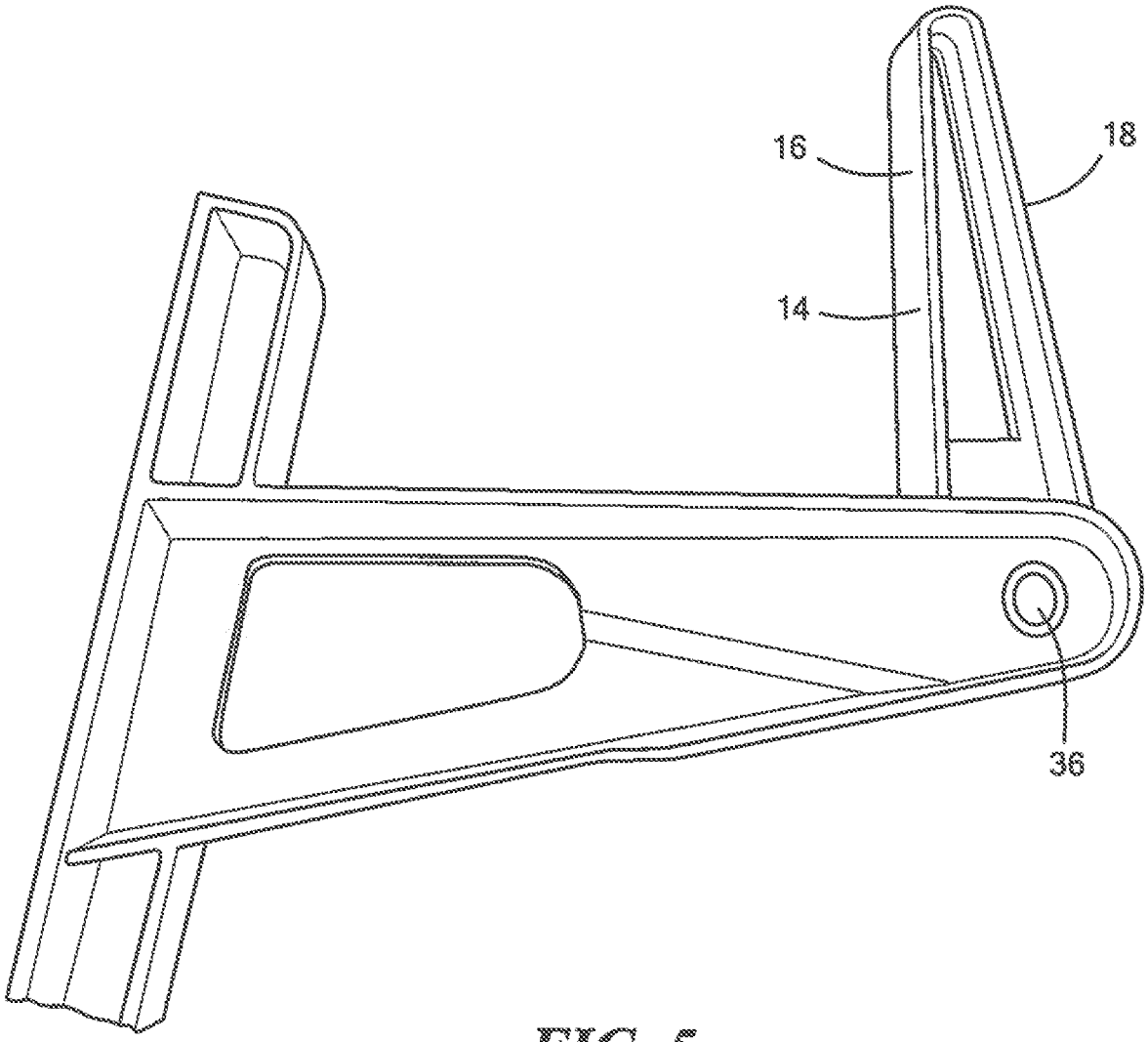
FIG. 5 is a schematic view showing how the wall rack bracket arm extension pivots relative to the arm.
Figure 6:
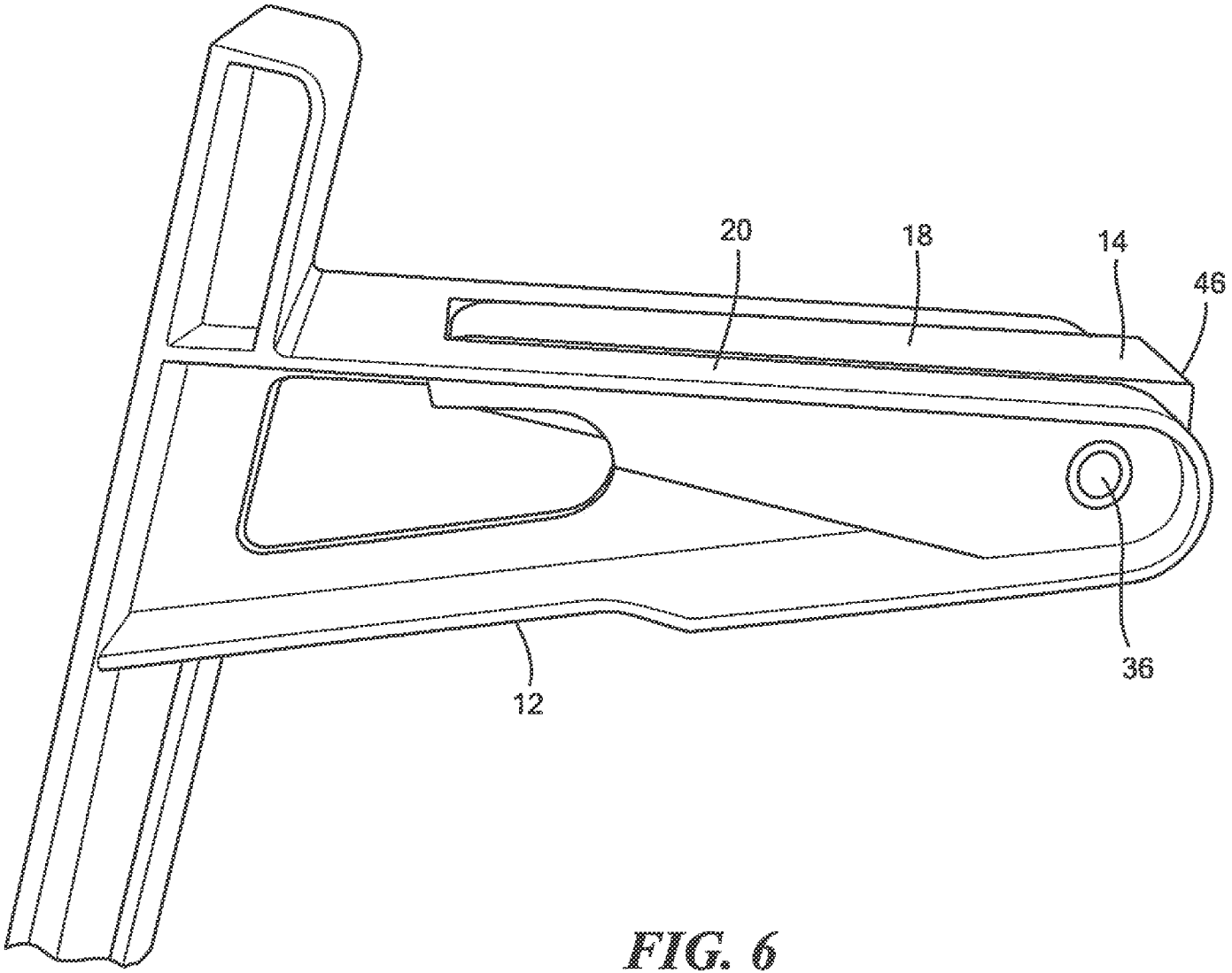
FIG. 6 is a schematic view showing the extension now stored with respect to the arm for supporting narrower items.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer, FIG. 1 shows a wall rack with first and second wall mountable brackets 10*a*, 10*b* each preferably including a plurality of spaced outwardly extending arms 12, FIG. 3 fixed to the bracket for supporting items thereon or therein as shown in FIGS. 1-2. Preferably, each arm 12 includes a pivotable extension 14 deployable to support an item and also movable to a stored position. Preferably, as shown in FIGS. 4-6, surface 16 of pivotable extension 14 forms a support surface for items placed thereon when the pivotable extension is deployed and opposing surface 18 of the pivotable extension forms a part of the top support surface 20 of arm 12 when pivotable extension 14 is folded and stored in arm 12. Thus, pivotable extension surface 18, FIG. 6 is flush with top surface 20 of arm 12 when pivotable extension 14 is stowed and pivotable extension 14 surface 18 lies in the same plane as top surface 20 of arm 12 when pivotable extension 14 is stowed. Also, opposing surface 16 of pivotable extension 14 is co-extensive with arm 12 top support surface 20 when pivotable extension 14 is deployed as shown in FIG. 4.

Figure 7:
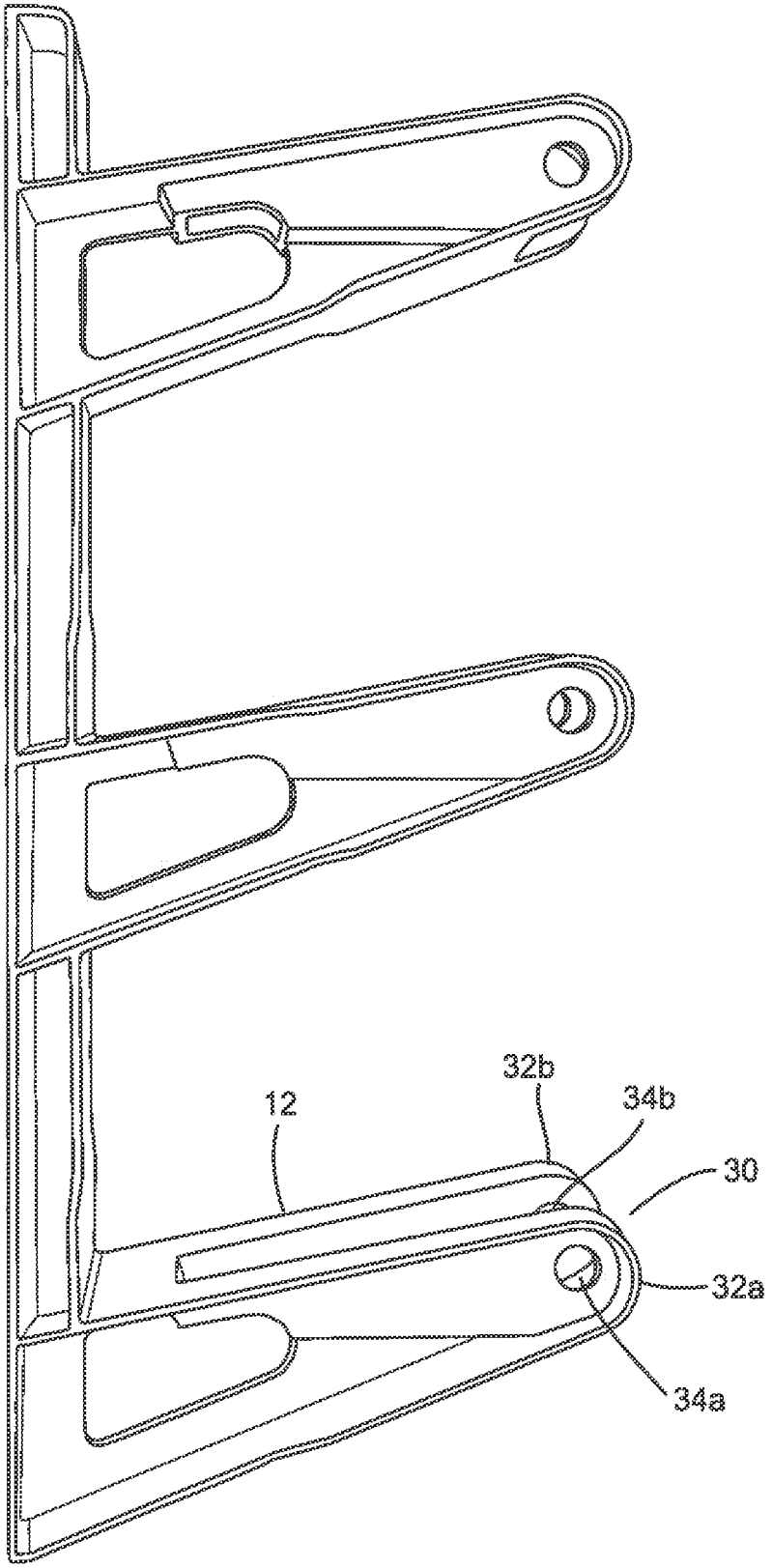
FIG. 7 shows a wall rack bracket arm configured for a pivotable extension.
Figure 8:
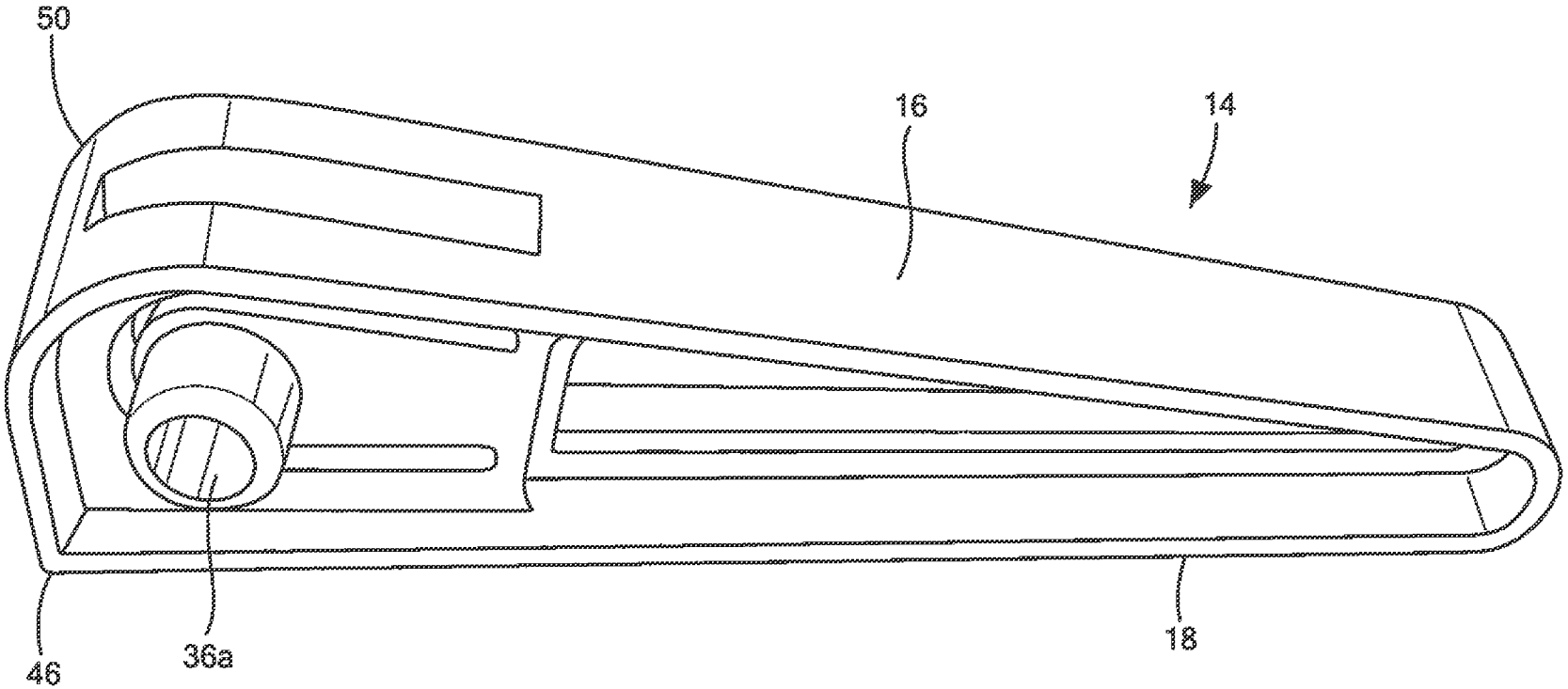
FIGS. 8-9 are schematic views showing an example of an extension.
Figure 9:
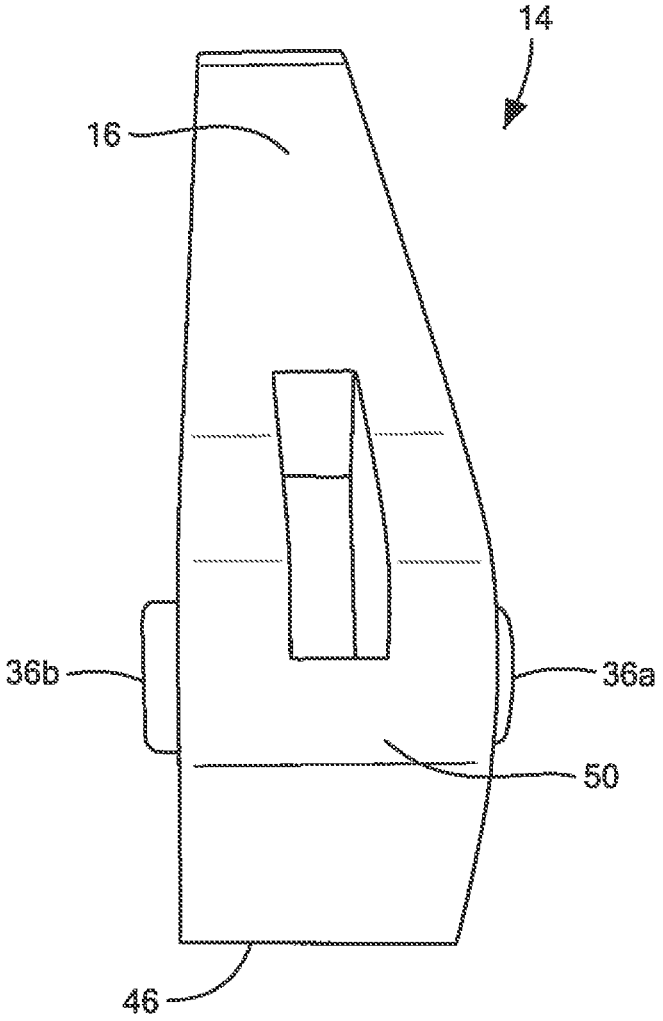
Figure 10:
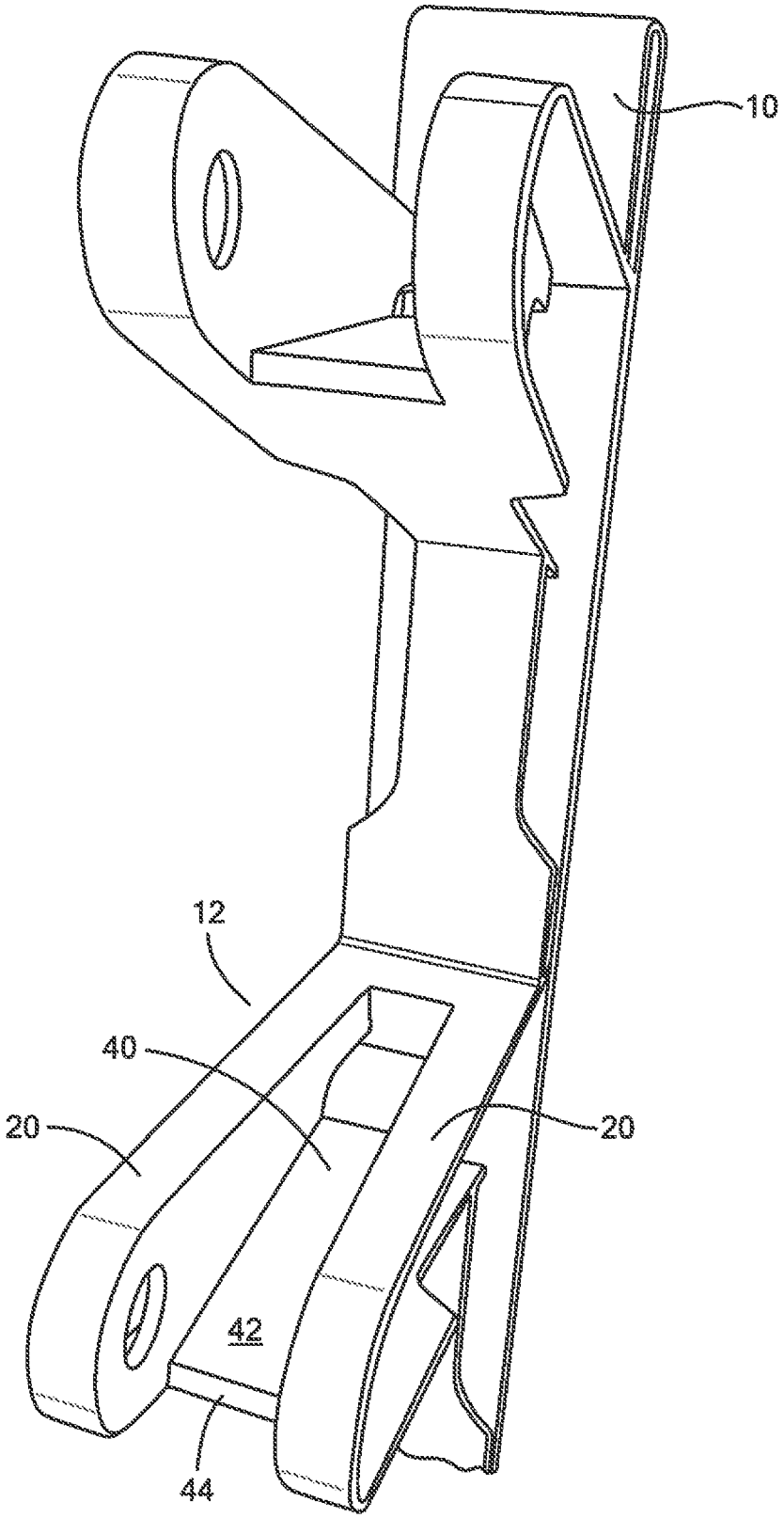
FIG. 10 is a schematic view showing an example of a channel in the wall rack bracket arm for storing the extension therein.

The arms 12 preferably terminate in yoke section 30, FIG. 7 including, in this embodiment, spaced ears 32*a*, 32*b* each with a respective orifice 34*a*, 34*b* and pivotable extension 14, FIGS. 8-9 includes outwardly extending proximal posts 36*a*, 36*b*, each received in a respective orifice 34*c*, 34*b*, FIG. 7 of arm yoke section 30. As shown in FIG. 10, each arm 12 preferably includes a top channel 40 therein for storing the pivotable extension. Floor 42 of channel 40 terminates in edge 44 which engages right angled edge 46 (FIGS. 6, 8, and 9) of the extension and acting as a stop for the pivoting extension 14 to limit rotation of the pivotable extension to 180° as shown in FIG. 4.

Thus, in this preferred design, triangular pivoting extension 14, FIGS. 8-9 has opposing surfaces 16 and 18 and proximal end 50 curves from surface 16 to surface 18 to form a right angle edge 46 acting as a stop for when the pivotable extension is deployed and edge 46 engages channel floor terminal surface 44, FIG. 10.

Figure 3:
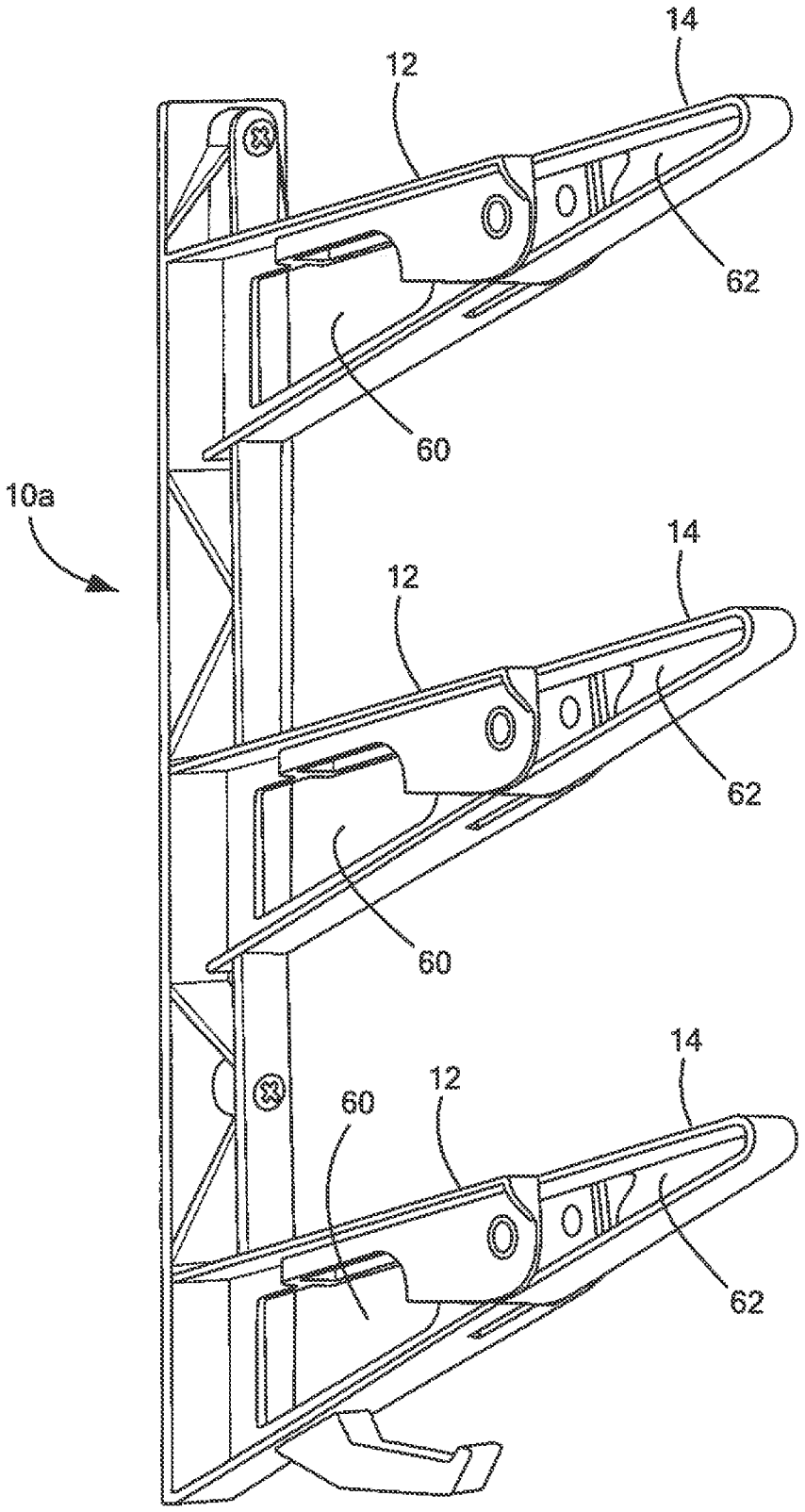
FIG. 3 is a schematic view showing an example of one bracket of the wall rack.

As shown in FIG. 3, the arms and/or the pivotable extensions preferably include channels 60, 62 crosswise therethrough for items such as fishing poles or the like.

Figure 11:
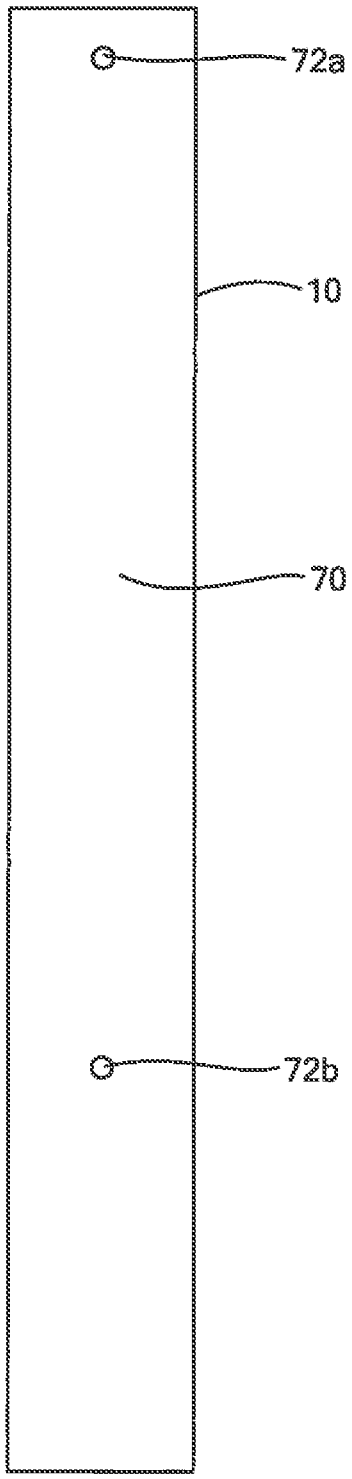
FIG. 11 is a schematic view showing the rear side of the wall rack bracket.

FIG. 11 shows rear surface 70 of bracket 10 with holes 72*a*, 72*b* for securing the bracket to a wall or other surface using mechanical fasteners such as screws.

The bracket and its arms may be molded plastic as is the extension.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant cannot be expected to describe certain insubstantial substitutes for any claim element amended.

What is claimed is:

1. A wall rack comprising:

first and second mountable brackets;

each bracket including a plurality of spaced arms extending outwardly from the bracket for supporting items thereon;

at least one arm of said plurality of arms of each bracket including an extension deployable to support an item and moveable to a stored position in a channel in said at least one arm;

said arm including a top surface and said extension including a corresponding first surface for supporting items thereon in a deployed position and an opposite surface for supporting items thereon in the stored position when the extension is stored in the channel; and the opposite surface of the extension lies in the same plane as the arm top surface with the extension is stored in the channel.

2. The wall rack of claim 1 in which the extension pivots relative to said arm.

3. The wall rack of claim 1 in which there are at least two arms per bracket and each includes a pivotable extension.

4. The wall rack of claim 1 in which said arm terminates in a yoke section and the extension is received in the yoke section.

5. The wall rack of claim 4 in which the yoke section includes a pair of spaced ears each with an orifice and the extension includes outwardly extending posts each received in a said orifice.

6. The wall rack of claim 4 in which the extension includes a stop surface engaging said arm prohibiting the extension from pivoting more than about 180° with respect to said arm.

7. The wall rack of claim 1 in which the channel includes a floor terminating in an edge engaging the extension when the extension is deployed.

8. The wall rack of claim 1 in which said extension includes a channel therethrough.

9. The wall rack of claim 1 in which the plurality of spaced arms each include a channel therethrough.

10. The wall rack of claim 1 in which the extension first surface, in the deployed position, is co-extensive with the arm top surface.

* * * * *